United States Patent [19]

Tredway, Sr.

[11] 3,954,271

[45] May 4, 1976

[54] GOLF CLUB SWING TRAINING DEVICE

[76] Inventor: Wynn B. Tredway, Sr., P.O. Box 130, Freeport, Pa. 16229

[22] Filed: Nov. 19, 1974

[21] Appl. No.: 525,211

Related U.S. Application Data

[62] Division of Ser. No. 368,814, June 11, 1973, Pat. No. 3,863,933.

[52] U.S. Cl. ..... 273/186 A; 273/183 B; 273/193 R

[51] Int. Cl.[2] ..... A63B 69/36

[58] Field of Search ..... 273/183, 186, 192, 170, 273/29 A, 191, 193; 46/228

[56] References Cited

UNITED STATES PATENTS

| | | | |
|---|---|---|---|
| 744,348 | 11/1903 | Hurst | 273/186 A |
| 989,944 | 4/1911 | Bramson | 46/228 X |
| 2,723,125 | 11/1955 | Comee | 273/186 A |
| 3,301,561 | 1/1967 | Kaiser | 273/192 X |
| 3,368,817 | 2/1968 | Duncan | 273/183 B |
| 3,707,055 | 12/1972 | Pearce | 46/228 |
| 3,861,688 | 1/1975 | Butler | 273/183 B |

*Primary Examiner*—George J. Marlo
*Attorney, Agent, or Firm*—Sherman H. Barber

[57] ABSTRACT

Apparatus that is adapted for grasping like a golf club has indicator lights thereon that when actuated indicate to a golf pupil as he swings the simulated golf club apparatus whether or not he is swinging the apparatus correctly.

5 Claims, 3 Drawing Figures

GOLF CLUB SWING TRAINING DEVICE

CROSS REFERENCE TO RELATED APPLICATION

This is a division of application Ser. No. 368,814, filed June 11, 1973, now U.S. Pat. No. 3,863,933.

BACKGROUND OF THE INVENTION

This invention relates to apparatus for teaching both young and old golf pupils as well as golfers how to swing a golf club correctly. When properly swung and after much repetition, correct muscle activity will gradually develop into lasting muscle memory that stays with a golfer for a long while.

In most cases golf pupils unfortunately practice bad habits and they try to bring the golf club down through on the same path the club traveled on the backswing. This is a physical impossibility. Whereas, in truth, the golfer and pupil should take the club back along one path during the backswing, and down through the ball-striking position along an entirely different path.

A golf pupil can observe and try to copy the swing of his favorite golf professional, whose book on Golf is usually well illustrated with photographs. But, soon the golf pupil comes to the realization that he cannot swing his clubs like his favorite professional, and so the pupil becomes discouraged. He then adds another book to his library of golf books and he is no better off than when he first read the golf book.

The prior art is replete with devices that are designed to teach a golf pupil how to achieve that elusive "perfect swing", but, so far as is known, no prior art reference has been found to be completely satisfactory.

The intentional alignment of the face of the golf club to the ball has long been the main obstacle of a good golf swing. It should be realized that the face of the club head is square to the line of intended flight of the ball for only a split second of time during the perfect swing. Yet, most golfers and golf pupils try to keep the face of the club square to the flight path at all times. Such intentional effort takes away from the player and from the pupil alike the fluidity of swing and body movement that is needed to properly strike a golf ball.

Use of the present invention, however, instills in the mind of the pupil and the golfer a "mind's eye view" of the correct golf swing, and it takes away from the pupil and the golfer, when the apparatus of the invention is manipulated correctly, the natural inclination to want to "steer" the club head along a certain, but incorrect path toward the ball.

I have found that once a golf pupil and golfer learns how to make a proper backswing, he instinctively makes a proper downswing. Using the apparatus and practicing the method of my invention achieves this objective.

SUMMARY OF THE INVENTION

A golf training apparatus in accordance with my invention comprises a light on a simulated golf club lights when contact of an arcuate structure on the club is made with a source of electrical power and when the pupil or golfer holds the simulated golf club in the proper position at the top of the backswing.

For a further understanding of my invention, and for features and advantages thereof, reference may be made to the following description and drawings which illustrate embodiments of apparatus in accordance with my invention which are suitable for carrying into practice the method of my invention.

DETAILED DESCRIPTION

Figure 1:
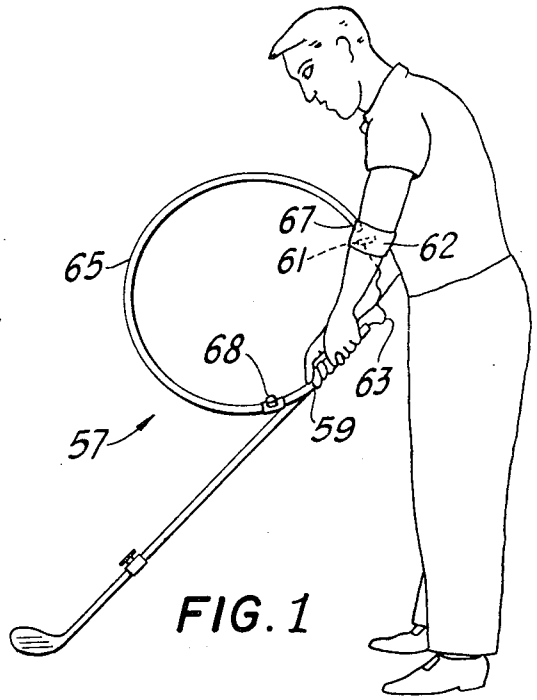
FIG. 1 is a schematic view of a golf training apparatus in accordance with my invention showing it being held by a golf pupil in the address position.

FIG. 1 illustrates schematically a golf training apparatus 57 as it is held by the golf pupil in the address position; the pupil holding the apparatus 57 by the gripping portion 59 thereof. The golf pupil would have received some previous instructions about holding the club device 57 and how to address the ball in practice. The golf pupil wears an electrified contact 61 on his left arm (a left handed pupil would of course wear the contact 61 on his right arm) that is located at or just slightly above the elbow. The electrified contact 61 is secured in place on an elastic band 62 or in any other manner and a small electric wire 63 leads from the contact piece 61 to the gripping portion 59 of the simulated golf club training apparatus 57, in which there is a source of electricity such as a small battery (not shown).

The apparatus 57 is fitted with an arcuate member 65 that may be made of metal or that may be plastic or any other suitable material. If it is made of plastic, it should include an electric wire that connects to a metal contact piece 67 at the free end and that connects to the source of electric power in the gripping portion 59. If the arcuate member 65 is metal, it should be connected to the source of power in a known way.

Figure 2:
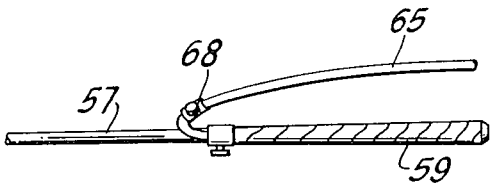
FIG. 2 is a plan view of just the gripping end portion of the apparatus of FIG. 1.

FIG. 2 illustrates schematically a plan view of the golf training device 57 of FIG. 1.

Figure 3:
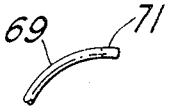
FIG. 3 is a view of a portion of the apparatus of FIG. 1.

The free end portion of a modified arcuate member 69 in which there is a microswitch 71 is shown in FIG. 3. The microswitch 71 is connected electrically to the source of power in the gripping portion 59 and is actuated upon contact with the arm, particularly the left arm, of the golf pupil in the manner described hereinafter.

In using the apparatus of FIG. 1, the golf pupil, wearing the arm band 62 as shown, assumes a correct address position holding the apparatus as shown. Then, he simulates rotation of the arcuate structure 65 as a golf club. At the address position, the metal end 67 or metal arcuate member 65 does not make contact with the electrified contact 61, but when the pupil moves the golf training apparatus 57 correctly to the proper position at the top of the backswing, the end 67 does contact the piece 61 which completes an electric circuit and light 68 on the arcuate portion lights up.

If the light 68 does not light up at the top of the backswing, the golf pupil knows that he is not holding the apparatus in the proper position. He should then assume the address position and repeat the backswing, but this time he should correct any fault so that contact will be made and the light lights.

Naturally golf pupils are not alike physically, even as some are men and some women, so each pupil must locate the arm band in the proper place for him or her under the guidance of an experienced teacher or professional. But, once the arm band is set in the proper position, the golf pupil should practice then until he can bring the apparatus to the top of the backswing every time and make contact with the electrified piece and light the light. The backswing may then be said to be "grooved".

From the foregoing description of my invention, those skilled in the art will recognize many important features and advantages of the invention, among which the following are particularly significant:

That the apparatus and its use quickly instills in a golf pupil and a golfer alike a mind's eye view of the correct golf swing. All mental control over the downswing is removed so that there is no attempt to steer the club head toward the golf ball;

That the golf pupil and the golfer alike obtain a proper picture of the correct swing which otherwise is only an optical illusion that he cannot ever attain from following or aping pictures in a book and;

That in swinging my apparatus in accordance with the uses described herein, a cocking of the wrists and a turning of the shoulders and hips in the proper manner takes place instinctively.

Although the invention has been described herein with a certain degree of particularity, it is understood that the present disclosure has been made only as an example and that the scope of the invention is defined by what is hereinafter claimed.

What is claimed is:

1. A training apparatus for indicating when a pupil properly positions a golf club comprising:

a. a shaft having a gripping portion held and maneuvered by said pupil;

b. an arcuate member mounted to said shaft and curving toward said gripping portion;

c. an electrical contactor worn upon one arm of said pupil;

d. an electrical indicator in circuitry with said arcuate member and said contactor whereby when said shaft is properly positioned as a golf club at the top of the backswing, said arcuate member contacts said electrical contactor and said indicator is actuated to indicate the proper position of said shaft.

2. The invention of claim 1 wherein:

a. said indicator is a light, and said circuitry is powered.

3. The invention of claim 2 wherein:

said light is mounted to said arcuate member.

4. The invention of claim 1 including:

a. a microswitch carried by said arcuate member which switch contacts said contactor when said shaft is properly held at the top of the backswing.

5. A training apparatus for indicating when a pupil properly positions a golf club comprising:

a. a shaft having a gripping portion held and maneuvered by said pupil;

b. an arcuate member mounted to said shaft and curving toward said gripping portion;

c. an electrical contactor worn upon one arm by said pupil;

d. a light mounted to said shaft and connected in powered circuitry with a microswitch carried by said arcuate member whereby when said shaft is properly positioned as a golf club at the top of the backswing, said microswitch contacts said contactor and said light lights.

* * * * *